US006491766B1

(12) United States Patent
Baldi et al.

(10) Patent No.: US 6,491,766 B1
(45) Date of Patent: Dec. 10, 2002

(54) ACTIVATED NICKEL SCREENS AND FOILS

(75) Inventors: Alfonso L. Baldi, Jupiter, FL (US); Frank J. Clark, Newark, DE (US)

(73) Assignee: Alloy Surfaces Co., Inc., Chester Township, PA (US)

( * ) Notice: Subject to any disclaimer, the term of this patent is extended or adjusted under 35 U.S.C. 154(b) by 38 days.

(21) Appl. No.: 09/692,030

(22) Filed: Oct. 19, 2000

Related U.S. Application Data

(62) Division of application No. 09/267,860, filed on Mar. 12, 1999, now Pat. No. 6,258,461.

(51) Int. Cl.[7] ..... C23C 22/00

(52) U.S. Cl. ..... 148/243; 148/251; 148/274; 148/283; 427/304; 427/328; 427/376.8

(58) Field of Search ..... 427/304, 328, 427/376.8; 148/243, 251, 274, 283

(56) References Cited

U.S. PATENT DOCUMENTS

| | | | | |
|---|---|---|---|---|
| 4,116,804 A | | 9/1978 | Needes | |
| 4,169,025 A | | 9/1979 | Needes | |
| 4,251,344 A | | 2/1981 | Needes | |
| 4,349,612 A | | 9/1982 | Baldi | |
| 4,396,473 A | | 8/1983 | Hughes et al. | |
| 4,443,557 A | | 4/1984 | Baldi | |
| 4,518,457 A | | 5/1985 | Gray | |
| 5,102,700 A | * | 4/1992 | Baldi | 216/100 |
| 5,366,765 A | * | 11/1994 | Milaniak et al. | 427/229 |
| 5,464,699 A | | 11/1995 | Baldi | |
| 5,795,659 A | | 8/1998 | Meelu et al. | |
| 6,110,262 A | | 8/2000 | Kircher et al. | |

* cited by examiner

*Primary Examiner*—John Sheehan
*Assistant Examiner*—Andrew L. Oltmans
(74) *Attorney, Agent, or Firm*—Connolly Bove Lodge & Hutz LLP

(57) ABSTRACT

A coating composition and process have been developed to provide an activated coating on nickel screen for use as cathodes in electrolytic cells for the generation of hydrogen and oxygen. Compared to the earlier Classical Pack Cementation process, the disclosed process is less expensive, reduces processing time from 20 hours to a few minutes, eliminates dusts and toxic gases, and provides improved performance in cells for hydrogen and oxygen generation. The coating is characterized by the presence of two activated layers with a high surface area, a multitude of fissures and a nickel to aluminum weight ratio greater than 20/1 in the top layer and greater than 4/1 in the bottom layer adjacent to the nickel substrate.

20 Claims, 4 Drawing Sheets

ACTIVATED NICKEL SCREENS AND FOILS

CROSS-REFERENCE TO RELATED APPLICATION

The present patent application is a divisional of U.S. patent application Ser. No. 09/267,860 filed on Mar. 12, 1999 now U.S. Pat. No. 6,258,461 in the names of Alfonso L. Baldi and Frank J. Clark.

FIELD OF THE INVENTION

The present invention relates to a coating composition and process that provide an activated coating on nickel screen. The coated nickel screen can be used as the cathode in an electrolytic cell that is designed for the generation of hydrogen and oxygen from an aqueous alkaline solution. A preferred coating is characterized by the presence of two activated layers with a high surface area, a multitude of fissures and a nickel to aluminum weight ratio greater than 20/1 in the top layer and greater than 4/1 in the bottom layer that is adjacent to the nickel substrate.

BACKGROUND OF THE INVENTION

Activated nickel screens are currently being used for the synthesis of methane and the generation of hydrogen and oxygen in electrolytic cells containing an aqueous alkaline medium. In methane synthesis a mixture of carbon monoxide and hydrogen are passed over the activated nickel screens to form methane and water. In the production of hydrogen and oxygen in electrolytic cells, the activated nickel screens are used as the cathode. The activated screens, when used as the cathode in an electrolytic cell, lower the overvoltage and show more than a 20% improvement in efficiency over untreated nickel screens. It is believed that the superiority of the activated nickel screens is due, at least in part, to the increased surface area that results from the activation step. The activated screens have been used in electrolytic cells for the generation of hydrogen and oxygen for about ten years.

Hydrogen is presently being used as a fuel for industrial applications as well as a fuel for automobiles. The advantage of hydrogen as an automobile fuel include a greater energy release per unit weight of fuel and the absence of polluting emissions including carbon monoxide, carbon dioxide, nitrogen oxide, sulfur oxides, hydrocarbons, aldehydes, and lead compounds (i.e., the combustion products of hydrogen are primarily water with minute traces of nitrogen oxide).

The known process to produce the activated nickel screens included placing each individual nickel screen in a "pack" composed of a powder mixture containing aluminum, aluminum oxide and a halide salt activator followed by a heating operation (i.e., for several hours at elevated temperatures). This is known as the Classical Pack Cementation process and is disclosed in U.S. Pat. No. 4,349,612. The chemistry of this process during the heating step includes the reaction of the halide with aluminum to yield gaseous aluminum sub halide such as aluminum sub chloride (AlCl). As this gas passes over the nickel screen, it decomposes and deposits aluminum on the nickel surface. The process is carried out for 20 to 30 hours at 800–1200° F. in a hydrogen atmosphere. At this temperature the deposited aluminum diffuses into the nickel surface to form a coating comprising an aluminum rich nickel aluminide ($Ni_2Al_3$). The process is labor intensive, requires long processing times, gives off obnoxious dusts during loading of the screens and emits corrosive and toxic halide gases during the heating operation. In order to prevent contamination of the environment, the effluent gases must be scrubbed under alkaline conditions to neutralize and remove the toxic gases. In addition, after each processing cycle, the coating powder must be sifted and replenished for the next load of screens. The powder mixture is sensitive to water absorption and must be kept dry when not in use. Otherwise the moisture will react with the activator in the pack and curtail its function.

After the formation of the nickel aluminide coating on the nickel screens, the screens are immersed in a 20% solution of sodium hydroxide for about 40–60 minutes at 180–200° F. to selectively leach out at least a portion of the aluminum from the nickel aluminide coating. The screens are then rinsed in water and passivated by immersion for one hour in hot water at 180 to 212° F. followed by a one hour immersion in a water solution containing 2–5% hydrogen peroxide at 74° F. followed by rinsing in water and finally drying in an oven at 140–160° F. to remove all water from the screen. After the foregoing processing, the screens are ready to be used as cathodes in electrolytic cells containing an aqueous alkaline medium (for example, 25% NaOH or 25% KOH in water). In these electrolytic cells, hydrogen is produced at the cathode and oxygen is produced at the anode. The anodes of the cells are usually composed of virgin (untreated) nickel. It is preferred that the anodes contain pores or openings (e.g., nickel screen).

SUMMARY OF THE INVENTION

The present invention includes the production of activated nickel screens with even greater activity than those produced by the aforementioned Classical Pack Cementation process. Further, the present invention includes a unique coating procedure which eliminates all of the disadvantages inherent in the Classical Pack Cementation process.

In the process of the present invention, the nickel screens are coated in a simple dipping procedure with a slurry of aluminum powder dispersed in a binder/organic solvent system or binder/water system. The coating must completely cover the surfaces of the wires that form the screen. After an initial drying step to remove the organic solvent or the water, the coating weight on the screen should not exceed about 30 mg/sqcm and should not be less than 10 mg/sqcm. The coated screen is next placed directly in a furnace under a nitrogen, hydrogen or inert atmosphere at a temperature of from about 1450–1750° F. for a time of from about one to fifteen minutes. Coatings exceeding about 30 mg/sqcm will cause embrittlement of the wire during the heating operation. Coatings that are less than about 10 mg/sqcm will give an incomplete coating of the wires in the screen. During the heating step, aluminum is diffused into the surface of the nickel wires that form the screen where the aluminum reacts with the nickel to form nickel aluminides. By the end of the heating step, a coating has formed on the nickel wires. The portion of the coating that is closest to the external environment is predominantly $NiAl_3$ and aluminum, whereas the portion of the coating that is closest to the nickel wire is predominantly $Ni_2Al_3$ and nickel. Subsequent leaching of the aluminum from this coating in a water solution containing 20% sodium or potassium hydroxide at 180–200° F. provides a coating with greater activity than the coating that is formed in the Classical Pack Cementation process which does not have the same structure as the coating of the present invention. In addition to its greater activity, the process of the present invention offers substantial cost savings in labor and the elimination of the release of obnoxious dusts and toxic gases during the coating and heating steps. In addition, as is shown in FIG. 1, there is a marked improvement in the performance of the electrolytic cells that used the activated nickel screens produced by the process of the present invention compared to the activated nickel screens produced by the Classical Pack Cementation process. This improvement in properties is believed to be a result of the differences in structure and composition between the coating of the present invention (i.e., the coating formed on the nickel screens) and the coating formed by the Classical Pack Cementation process. Specifically, the coating of the present invention (i.e., when viewed at 800× magnification) appears to have two parts or sections, see FIGS. 3 and 5. The outer part or section has a serrated appearance with the points of the toothlike projections facing outward (i.e., towards the external environment). The nickel to aluminum ratio (by weight) in this outer part or section of the coating is at least 20 to 1. The inner part or section, which is contiguous with the nickel wire of the screen, has the appearance of a substantially solid or uniform layer that is interlaced with fissures or cracks. The nickel to aluminum ratio (by weight) in this inner part or section of the coating is at least 4 to 1. In contrast, the coating that is formed by the Classical Pack Cementation process has only one part or section which has the appearance of a solid or uniform layer (see FIGS. 2 and 4). Further, the coating that is formed by the Classical Pack Cementation process does not have as many fissures or cracks as the inner part or section of the coating that is formed by the process of the present invention. Finally, the coating that is formed by the Classical Pack Cementation process (before the leaching step) is composed predominantly of $Ni_2Al_3$. After the leaching step, the ratio of nickel to aluminum in the coating is about 3.3 to 1.

The two part structure of the coating of the present invention in combination with the increased number of fissures or cracks in the coating result in an increased surface area that is available for interaction with the external environment. In addition, the coating of the present invention also has a higher nickel to aluminum ratio than the coating formed by the Classical Pack Cementation process. The combination of these differences results in an activated nickel screen (i.e., the screen of the present invention) that has superior properties (e.g., superior catalytic properties) than the activated nickel screen that is produced by the Classical Pack Cementation process.

Another major advantage of the innovative coating process of the present invention over the Classical Pack Cementation process is that the process of the present invention can be run continuously whereas the Classical Pack Cementation process was a labor intensive batch process. Specifically, because the process of the present invention utilizes: (1) a simple dip-coating procedure to coat the nickel screen with aluminum powder and (2) a short heating step, it is possible to run the process in a continuous manner where a coiled screen is slowly uncoiled and first fed through a dip-coating station where the screen is coated with an aluminum containing slurry and then the slurry coated screen is passed through a heating unit where the liquid component of the slurry is removed before the screen is passed through a furnace to cause the aluminum powder to diffuse into the surface of the nickel wire that makes up the screen. The use of a powder bed in the initial coating step and the extremely long processing times required for the Classical Pack Cementation process would preclude such continuous processing.

The average particle size of the aluminum powder that is used to form the slurry of aluminum powder in the process of the present invention should be smaller than 40 microns but larger than about 5 microns. Too small a particle size will cause premature melting and run off of the aluminum from the screen during the heating operation, whereas too large a particle size will result in incomplete coating of the screen. The preferred particle size for the aluminum powder is between 5 and 20 microns.

During the leaching step, aluminum is removed from the nickel aluminides in the coating by the same process that is used in the Classical Pack Cementation process. Specifically, the coated nickel screens are immersed in a solution containing about 20% by weight sodium or potassium hydroxide in water for about one hour at a temperature of about 180–212° F., preferably about 200–212° F.

The major advantage in processing using the innovative process of the present invention is in the coating procedure. By using the process of the present invention, a substantial reduction in cost can be realized through a reduction in the labor costs associated with the Classical Pack Cementation process. In addition, by using the process of the present invention, it is possible to drastically reduce or even eliminate the release of obnoxious and harmful dusts and gaseous effluents into the environment that was associated with the Classical Pack Cementation process.

DETAILED DESCRIPTION OF THE PREFERRED EMBODIMENTS

Figure 1:
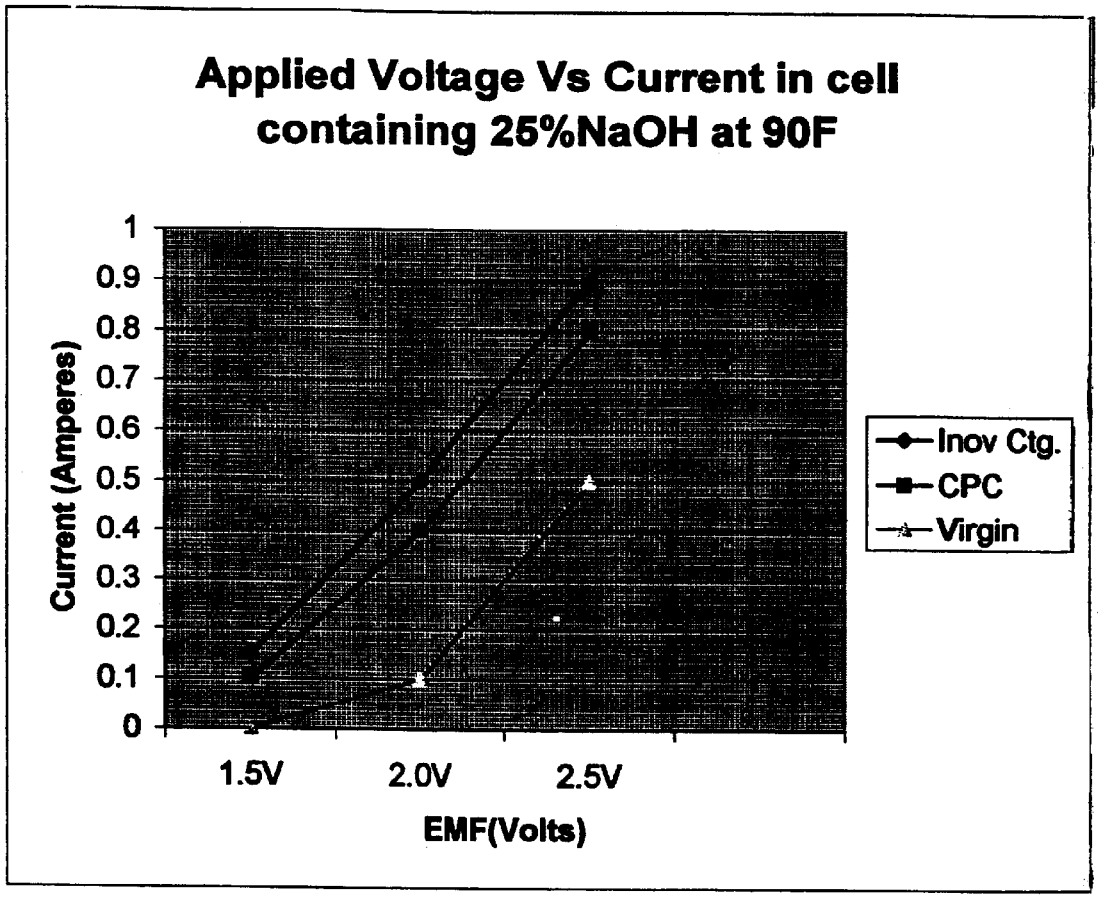
FIG. 1 is a graph of current (amperes) vs. applied voltage (volts) in an electrolytic cell containing 25% by weight NaOH in water at 90° F. for cathodes made of untreated virgin nickel screen, nickel screen coated by the Classical Pack Cementation process (CPC) and nickel screen coated by the process of the present invention (Inov Ctg). The anode in each case was an untreated (virgin) nickel screen.

The single layer diffusion coating formed by the Classical Pack Cementation process has been identified as $Ni_2Al_3$ (i.e., before the leaching and passivation steps). The two section diffusion coating formed by the process of the present invention has been identified as $NiAl_3$ in the outer part or section and $Ni_2Al_3$ in the inner part or section (i.e., before the leaching and passivation steps). An electron microprobe analysis of the coated screens formed by the process of the present invention and the coated screens formed by the Classical Pack Cementation process, after leaching (in a water solution containing about 20% by weight sodium or potassium hydroxide at 180–200° F. and passivation (in water for one hour at 180–212° F. followed by a one hour immersion in a water solution containing about 2–3% hydrogen peroxide at 75° F.)), shows that substantially more aluminum was leached from the coating of the present invention as compared to the coating of the Classical Pack Cementation process. This means that the final activated coating that is formed by the process of the present invention contains a greater quantity of activated nickel than the activated coating formed by the Classical Pack Cementation process. The final (i.e., after the leaching and passivation steps) Ni to Al ratio (by weight) in the single layer activated coating formed by the Classical Pack Cementation process was 3.3/1 while that in the activated coating of the present invention was 22.6/1 in the outer section and 4.7/1 in the inner section.

The greater number of fissures present in the activated coating of the present invention compared to the coating formed by the Classical Pack Cementation process is also believed to contribute to its greater activity. FIGS. 2–5 clearly show the increased number of fissures or pores in the coating of the present invention. In addition, surface area determinations were made by measuring the surface perimeter of both activated coatings under 200× magnification. The coating perimeter of the coating of the present invention was about two times greater than the coating perimeter of the coating formed by the Classical Pack Cementation process (i.e., in coated nickel wires where the diameter of the nickel wire core and the coating thickness were approximately the same for both samples). In addition, the surface areas of both coatings were determined by the well-known BET gas adsorption technique. Coated screen samples were heated to 275° C. in a vacuum for fifteen minutes and then exposed to nitrogen for adsorption onto the surfaces of the coatings. The amount of nitrogen adsorbed onto the surface of the coatings gives a measure of the surface area. The results of this test were as follows: 1 8.8 $m^2/g$ for the activated coating of the present invention and 11.5 $m^2/g$ for the activated coating formed by the Classical Pack Cementation process. The increased specific surface area of the activated coating of the present invention is another important factor which contributes to the increased activity of the coating of the present invention (i.e., as compared to the activated coating formed by the Classical Pack Cementation process).

The passivation of the activated coating is important when the coated nickel body must be exposed to air before use because the unpassivated coating is pyrophoric in air. A preferred method of passivating the activated coating involves contacting the activated coating (i.e., after the leached coating has been rinsed in water) with water at a temperature of about 180–212° F. (usually for about one hour) and then contacting the activated coating with a solution of hydrogen peroxide in water. The normal concentration of the solution is about 2–5% by weight hydrogen peroxide in water. At this concentration of hydrogen peroxide, the amount of time that the activated coating is kept in contact with the hydrogen peroxide solution is about one hour. As the concentration of the hydrogen peroxide in the solution is increased, the amount of time that the activated coating is contacted with the hydrogen peroxide solution is decreased. The maximum concentration of commercially available solutions of hydrogen peroxide in water is about 35% by weight hydrogen peroxide. At this concentration, the activated coating would only need to be contacted with the hydrogen peroxide solution for about 10–20 minutes. However, the use of such a highly concentrated solution of hydrogen peroxide is less desirable than the use of a weaker solution because the reaction between the metal compounds in the activated coating and the hydrogen peroxide in the solution becomes more violent as the concentration of the hydrogen peroxide increases. Accordingly, it is preferred to use a solution of about 2–5% hydrogen peroxide in water for a period of time of about one hour.

EXAMPLE 1

Classical Pack Cementation Coating

Figure 2:
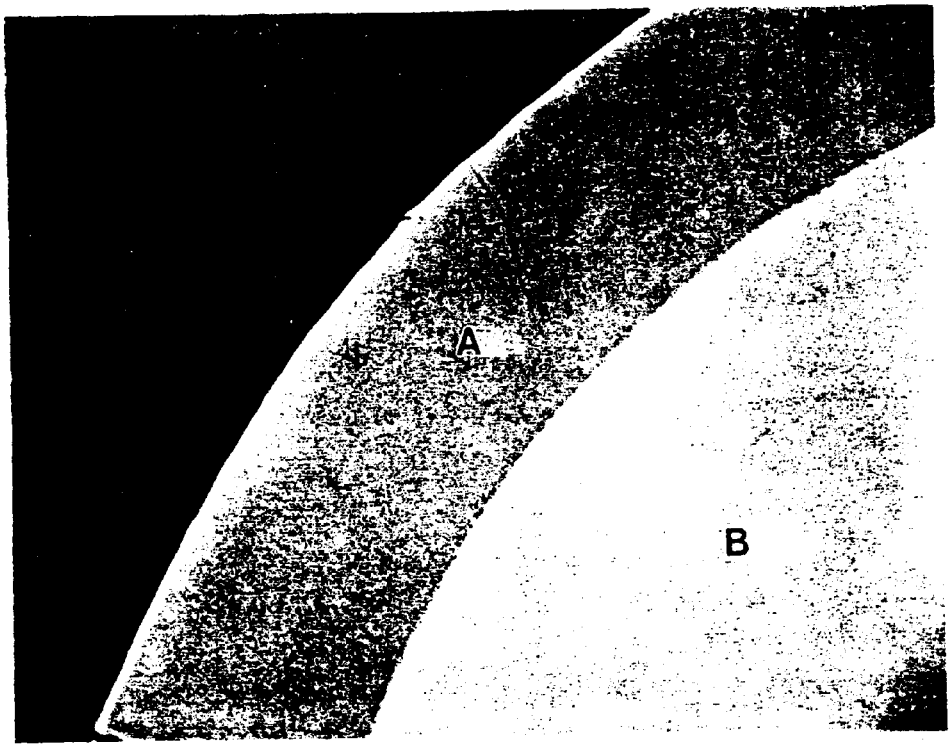
FIG. 2 is a micro graph at 800× magnification showing a cross-section of a nickel screen bearing a coating formed by the Classical Pack Cementation process (Example 1—after leaching).
Figure 4:
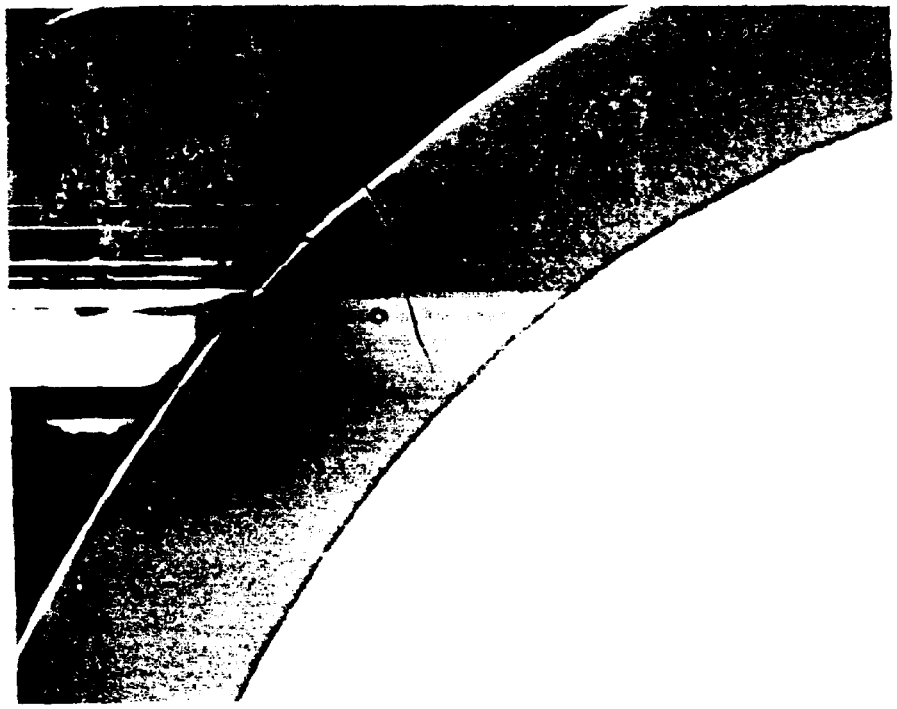
FIG. 4 is a photomicrograph (inverted specimen current image) at 800× magnification showing a cross-section of a nickel screen bearing a coating formed by the Classical Pack Cementation process (Example 1—after leaching).

1. Heat clean several 1 inch by 2.5 inch Nickel 200 screens (National Standard Co., Woven-Filter-Fiber Division, 14 mil or 0.014 inch wire thickness) in an oven for 15 minutes at 400° F. in air. According to the American Society for Metals Handbook Desk Addition (1985), the nominal composition of Nickel 200 includes 99.5%Ni; 0.08%C, 0.18%Mn, 0.005%S, 0.18%Si, 0.13%Cu and 0.2%Fe.
2. Prepare a powder mixture containing 20% by weight aluminum (V-125, Valimet, Inc., average particle diameter 40 microns), 79.5% by weight calcined aluminum oxide (A-12, East Technical Chemical Co., average particle diameter 40 microns) and 0.5% by weight aluminum chloride (97% aluminum chloride, Aldridge Chemical Co.).
3. Bury the nickel screens in the powder mixture which is contained in a nickel base alloy retort (Inconel 600, International Nickel Co.).
4. Place the retort in a gas fired furnace (Gas fired vertical furnace, American Gas Furnace Co.) and heat to 950° F. to 1000° F. in a hydrogen atmosphere.
5. After the internal temperature of the furnace reaches the 950–1000° F. temperature, hold the temperature at this level for 25 hours.
6. After the 25 hour heating period, turn off the furnace and allow the retort to cool down under a hydrogen atmosphere until the internal temperature of the furnace is below 100° F. After the furnace temperature is below 100° F., purge out all of the hydrogen with argon gas and then remove the retort from the furnace, open the retort and remove the screens, blow off any residual powder from the screens (with compressed air) and wash the screens in tap water at room temperature and dry in air.
7. Place the washed screens in a water solution containing 20% by weight sodium hydroxide for one hour at 180 to 212° F. to leach out aluminum from the coating.
8. Rinse the leached screens in tap water at room temperature and then place the rinsed screens in hot water for one hour at 180 to 200° F.
9. Place the screens in a solution containing about 3% by weight hydrogen peroxide in water for one hour at 75° F.
10. Rinse the screens in water and then dry the screens in air. The screens should not be pyrophoric when exposed to air. The weight gain for the screens should be about 5–6 mg/sqcm. Photomicrographs of a typical specimen are shown in FIGS. 2 and 4.

EXAMPLE 2

Innovative Coating of the Present Invention

1. Heat clean several 1 inch by 2.5 inch Nickel 200 screens (Nickel 200 woven screens, 20×20 mesh, 0.014 inch strand thickness, National Standard Co. Woven-Filter-Fiber Div.) in an oven for 15 minutes at 400° F. in air.
2. Prepare adispersion of150 grams of 8–10 micron average particle size aluminum powder (H-10 Valimet, Inc.) in an organic medium consisting of 275 grams of a nonflammable mixture of 17% ethyl methacrylate (B-72, Rohm and Haas) and 83% normal propyl bromide (Hypersolve INPB, Great Lakes Chemical Corp.).

Figure 3:
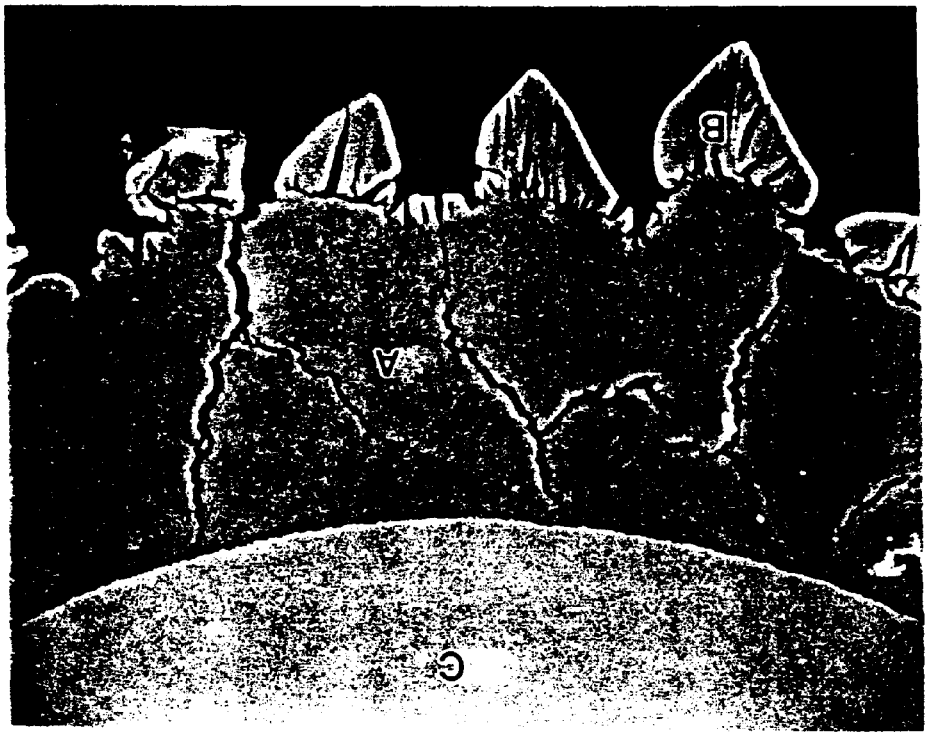
FIG. 3 is a micrograph at 800× magnification showing a cross-section of a nickel screen bearing a coating formed by the process of the present invention (Example 2—after leaching).
Figure 5:
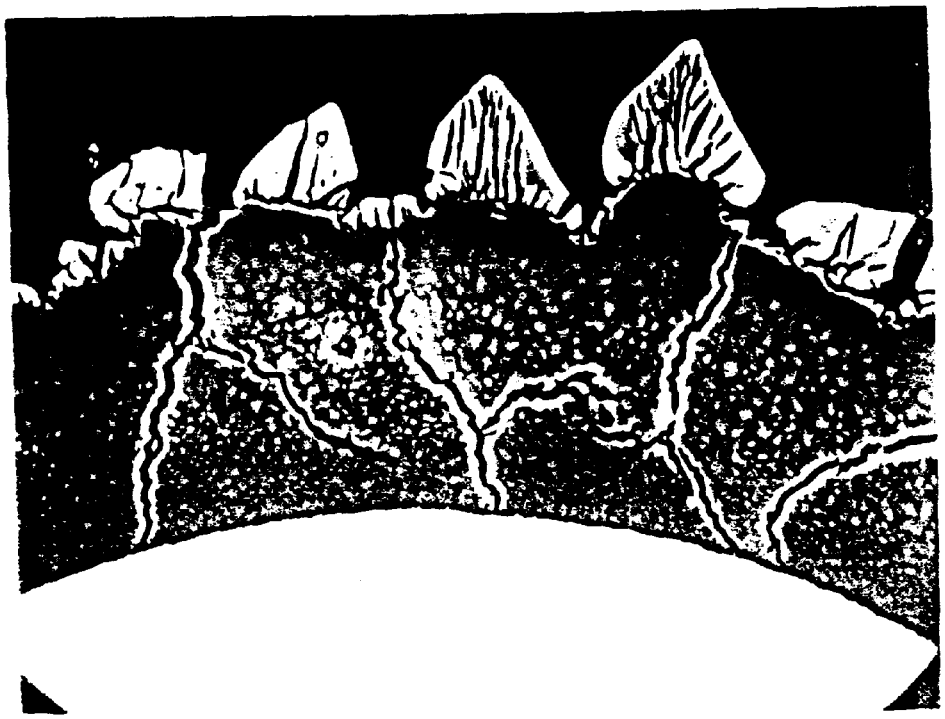
FIG. 5 is a photomicrograph (inverted specimen current image) at 800× magnification showing a cross-section of a nickel screen bearing a coating formed by the process of the present invention (Example 2—after leaching).

3. Dip the screens in the dispersion described in numbered paragraph 2 with slight agitation and gradually remove the screens from the dispersion while blowing warm air on the coated screens to produce a dry coating. The coating should completely coat all of the wires of the screen. If necessary, the dipping and drying process can be repeated until all of the wires of the screen are completely coated with the dried dispersion.
4. Slowly insert the coated screens into a tube in an electric furnace preheated to the holding temperature and then hold the coated screens under a hydrogen atmosphere at the holding temperature and for the time indicated below.
   a. about 1450° F. for about 5 minutes to give a coating thickness of less than 1 mil.
   b. about 1450° F. for about 15 minutes to give a coating thickness of about 2 mil.
   c. about 1550° F. for about 5 minutes to give a coating thickness of about 2 mil.
   d. about 1650° F. for about 5 minutes to give a coating thickness of about 3 mil.
   e. about 1750° F. for about 2 minutes to give a coating thickness of about 2 mil.
5. Gradually remove the screens from the furnace tube and allow the screens to cool to room temperature. After the screens have cooled to room temperature, the screens are immersed in a solution containing about 20% by weight sodium hydroxide in water for about one hour at about 200–212° F. to leach out most of the aluminum from the coating.
6. After the leaching step, the coated screens are rinsed in water and then immersed in hot water for about one hour at about 180–212° F.
7. After the rinsing and soaking step described in paragraph 6, the coated screens are immersed in a solution containing about 2 to 5% hydrogen peroxide in water for about one hour at about 75° F. and then the screens are rinsed in water and dried in air at room temperature. The coated screens should not be pyrophoric when exposed to air. The weight gain for the screen in (a) was only about 0.4 mg/sqcm. For the screens in (b)–(e), the weight gain was about 5–6 mg/sqcm. The photomicrographs shown in FIGS. 3 and 5 are typical of screens (b)–(e).

FIG. 1 depicts the performance of the coated nickel screens formed by the Classical Pack Cementation process and the coated nickel screens of the present invention (e.g., the screens formed in b,c,d and e). Screen a, which did not develop a sufficient coating, was slightly inferior to the coating formed by the Classical Pack Cementation (CPC) process. The activated screen that was formed by the process of the present invention and is represented by the "Inov Ctg." line in FIG. 1 was screen c from Example 2. The activated screen that was formed by the CPC process and is represented by the "CPC" line in FIG. 1 is the screen formed in Example 1. The "virgin" screen in FIG. I was the initial nickel screen that was used in Examples 1 and 2 (prior to coating). The data that was used to generate FIG. 1 is shown in Table 1.

TABLE 1

| EMF (Volts) | Inov Ctg. (Amperes) | CPC (amperes) | Virgin (amperes) |
|---|---|---|---|
| 1.5 | 0.15 | 0.1 | 0 |
| 2.0 | 0.5 | 0.4 | 0.1 |
| 2.5 | 0.9 | 0.8 | 0.5 |

In the process described in example 2, it is possible to use aluminum powder having a particle size ranging from about 5 microns to 40 microns instead of the 8–10 micron size aluminum powder. When the aluminum powder particle size is less than 5 microns, the aluminum can melt too rapidly and run off of the screen during the heating step. When the aluminum powder particle size is greater than about 40 microns, inadequate wetting of and incomplete coating of the wires in the nickel screen can occur.

In the process described in example 2, flammable solvents such as acetone can be used instead of the non flammable normal propyl bromide. Acetone however has a lower density (0.79 g/cc) than normal propyl bromide (1.43 g/cc) and requires more of the acrylate resin to increase its viscosity to adequately disperse the aluminum powder. Other solvents such as trichloroethylene and 1-1-1 trichloroethane, both having a density about equal to normal propyl bromide can be used, but these are objectionable from an environmental or toxicity standpoint. Other acrylate resins including polymers or copolymers of methyl methacrylate can be substituted for the ethylmethacrylate copolymer or polymer with the same good results.

The present innovative coating process can also be carried out in an aqueous system. For example, the process of example 2 was repeated with the changes discussed below. In step 2, a dispersion of 2000 grams of aluminum powder with a particle size of about 8 to 10 microns in 388 grams of water containing 24 grams of polyvinyl alcohol resin and 388 grams of propanol was used instead of the dispersion set forth in Example 2. When the water based system was used, it was necessary to dry the dispersion coated nickel screens in step 3 at 300° F. for about 15 minutes in warm flowing air to obtain a dry enough coating prior to the aluminum diffusion step, which was carried out at 1550° F. for about 5 minutes. After the leaching and passivation steps, the coated screens were tested in the 25% by weight NaOH in water electrolytic cell used to generate the data in FIG. 1. The nickel screens that were coated with the water based system gave the same good results as the nickel screens coated with the organic solvent system.

EXAMPLE 3

Continuous Treatment of Nickel Screen Coil Stock

The present innovative process can be used to continuously coat coils of nickel screen according to the following procedure:

1. Heat clean a 3 inch width×70 foot long coil of Nickel 200 screen (Nickel 200 woven screen, 20×20 mesh, 0.014 inch strand thickness, National Standard Co. Woven-Filter-Fiber Division) having a wire diameter of 0.014 mil and 380 openings per square inch for about 10 minutes at about 400° F.
2. Uncoil and pass screen continuously through a non flammable bath containing a dispersion of 1510 grams of aluminum powder having an average particle size of about 8-10 microns (H-10, Valimet Inc.) in 412 grams of ethyl methacrylate copolymer (B-72, Rohm and Haas) and 2336 grams of normal propyl bromide (Hypersolve NPB, Great Lakes Chemical Corp.).
3. Pass the dispersion coated screen from step 2 continuously between heated radiant tubes to evaporate the normal propyl bromide. Samples taken after step 3 but before step 4 had a coating weight of about 18.8 mg/sqcm.
4. Pass the coated screen from step 3 continuously through an electric furnace containing a hydrogen atmosphere at a temperature of about 1630° F. at a speed of about one (1) foot per minute so that the residence time of the coated screen in the furnace was about two minutes. A sample taken after the coated screen had exited the furnace was subjected to a gravimetric weight determination which showed that the coating weight was about 15.3 mg/sqcm.

5. Recoil the coated screen.
6. Immerse the coil of coated screen in a solution of about 20% by weight NaOH in water for about 40 minutes at about 180–200° F. to leach out aluminum from the coating.
7. After the leaching step, the coil of coated screen is rinsed in water and then immersed in water for about one hour at about 180–210° F.
8. After step 7, the coil is immersed in a solution of about 3% by weight hydrogen peroxide in water for about one hour at about 75° F.
9. After step 8, the coil is rinsed in water and then dried.
10. The coiled screen can now be uncoiled and cut into the desired lengths for use as cathodes in electrolysis cells for the generation of hydrogen at the cathode and oxygen at the anode.

Figure 6:
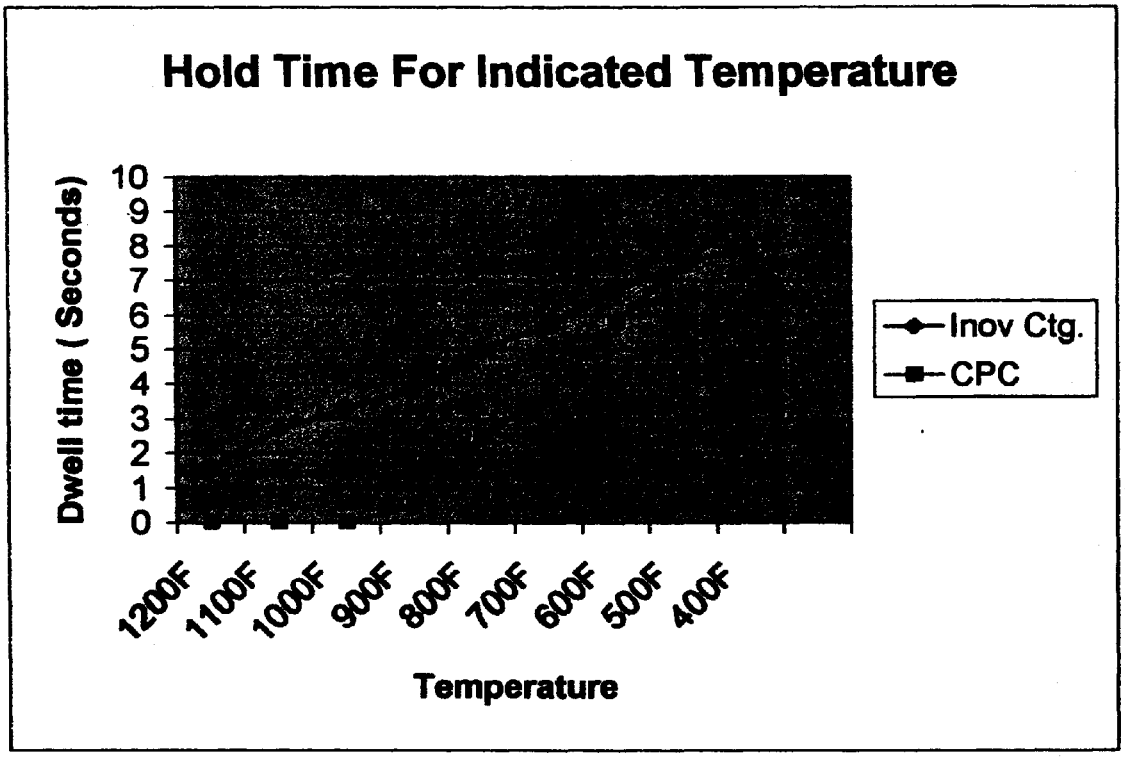
FIG. 6 is a graph of dwell time (seconds) vs. temperature for unpassivated specimens of nickel screen coated by the Classical Pack Cementation process and the process of the present invention after self-ignition in air.

The degree of activity of the activated nickel screens can also be determined by their heat output when subjecting an unpassivated nickel screen to air. After leaching and rinsing in water, the activated nickel screen will be pyrophoric and will instantly self ignite in air and liberate a quantity of heat corresponding to the free energy of formation of the oxidation of nickel to nickel oxide. FIG. 6 depicts the temperature versus dwell (hold) time for specimens made from the Classical Pack Cementation ("CPC") process and the present innovative process ("Inov Ctg.") upon exposure to an air flow of six cubic feet per second. This test shows appreciably more heat output for activated nickel screens prepared by the present innovative process. This demonstrates that there is a greater amount of activated nickel in the innovative coating formed by the process of the present invention as compared to the coating formed by the Classical Pack Cementation process. The data that was used to generate FIG. 6 is shown below in Table 2.

TABLE 2

| Temperature (° F.) | Dwell Time (seconds) Inov Ctg. | Dwell Time (seconds) CPC |
|---|---|---|
| 1200 | 1.6 | 0 |
| 1100 | 2.7 | 0 |
| 1000 | 3.3 | 0 |
| 900 | 3.8 | 0.5 |
| 800 | 5 | 2.5 |
| 700 | 5.7 | 3.8 |
| 600 | 6.7 | 5.8 |
| 500 | 7.5 | 7.5 |
| 400 | 8 | 9 |

The specimen of the activated nickel screen formed by the process of the present invention and represented by the "Inov Ctg." line in FIG. 6 was a 1 inch by 2.5 inch portion of screen b from Example 2. The specimen of the activated nickel screen formed by the CPC process and represented by the "CPC" line in FIG. 6 was a 1 inch by 2.5 inch portion of the activated screen formed in Example 1.

The aforementioned activated nickel screens in examples 2 and 3 inherently contain a multitude of openings, in addition to the pores and/or fissures in the activated coating itself, which are essential for circulation of the caustic electrolyte during the electrolysis reaction so that hydrogen can be efficiently produced at the cathode. In addition, it is also important that the anode also contain openings for the efficient production of oxygen.

In place of the nickel screens, perforated activated nickel foil with a thickness of at least 5 mils or expanded activated nickel foil with slit openings and having a thickness of about 10 mils can be effectively used in place of the screen. Although the degree of performance of the perforated foil and expanded nickel foil is not quite as good as the activated nickel screen, they are at least equal in activity to the prior art coatings formed by the Classical Pack Cementation process.

In a highly preferred embodiment of the present invention, the nickel screens are pressed (e.g., by one or more rollers or between two rollers) before they are coated with the aluminum powder. This pressing step flattens the nickel wires that make up the nickel screen. The resulting flattened screen has a thinner cross-section and slightly smaller openings but still resembles a screen. After the pressing step, the resulting flattened nickel screen is subjected to the same process steps that are described in either example 2 or example 3 (if the pressed screen is used in a continuous process). The pressed nickel screen can be coated more rapidly than the unpressed nickel screen thereby improving the rate of production of the coated nickel screens.

Crossections of activated nickel screen from example 1 (Classical Pack Cementation) and from example 2 (present invention) were taken for Electron Probe Microanalysis (EPA) with scanning electron microscopy (SEM) energy dispersive x-ray spectroscopy.

Secondary electron images (SEI) for the screens in example 1 and example 2 are shown respectively in the photomicrographs provided as FIGS. 2 and 3. Inverted specimen current images (ISC) are shown respectively in the photomicrographs shown in FIGS. 4 and 5.

The activated nickel screen produced by the Classical Pack Cementation process (Example 1—after leaching) and shown in FIGS. 2 and 4 has a uniform one layer coating with few visible fissures at 800× magnification.

The activated nickel screen produced by the process of the present invention (Example 2—after leaching) and shown in FIGS. 3 and 5 has a two part or section coating with numerous fissures in each part or section that are clearly visible at 800× magnification.

Quantitative Electron Probe Microanalysis shows the following percent by weight of indicated elements for the specimens, shown in FIG. 2 (Example 1—after the leaching and passivation steps) and FIG. 3 (Example 2—after the leaching and passivation steps).

TABLE 3

| | Ca | Al | Fe | Ni | O | Ni/Al |
|---|---|---|---|---|---|---|
| Example 1 (Classical Pack Cementation) | 0.13 | 19.23 | 0 | 63.11 | 17.52 | 3.28 |
| Example 2 (Present Invention) | | | | | | |
| Location B (Top Section) | 0.27 | 3.26 | 0.24 | 73.84 | 22.38 | 22.65 |
| Location A (Bottom Section) | 0.05 | 14.39 | 0.02 | 67.34 | 18.19 | 4.68 |

Based on the information provided in Table 3, it has been determined that the nickel-aluminum aluminum compound in the top section of the coating of the present invention, after the leaching and passivation steps, has an empirical formula of $Al_2Ni_{21}O_{23}$, whereas the nickel-aluminum compound in the bottom section of the coating of the present invention, after the leaching and passivation steps, has an empirical formula of $Al_2Ni_4O_4$.

The top section of the coating of the present invention, after the leaching and passivation steps, contains at least 50% by weight of the nickel-aluminum compound with the empirical formula $Al_2Ni_{21}O_{23}$ The bottom section of the coating of the present invention, after the leaching and passivation steps, contains at least 50% by weight of the nickel-aluminum compound with the empirical formula $Al_2Ni_4O_4$.

In a preferred embodiment of the present invention, the top section of the coating of the present invention, after the leaching and passivation steps, contains at least 60% by weight of the nickel-aluminum compound with the empirical formula $Al_2Ni_{21}O_{23}$ and the bottom section of the coating of the present invention, after the leaching and passivation steps, contains at least 60% by weight of the nickel-aluminum compound with the empirical formula $Al_2Ni_4O_4$.

In a highly preferred embodiment of the present invention, the top section of the coating of the present invention, after leaching, contains from 75 to 95% by weight of the nickel-aluminum compound with the empirical formula $Al_2Ni_{21}O_{23}$ and the bottom section of the coating of the present invention, after the leaching and passivation steps, contains from 75 to 95% by weight of the nickel-aluminum compound with the empirical formula $Al_2Ni_4O_4$.

In another preferred embodiment of the present invention, the top section of the coating of the present invention, after the leaching and passivation steps, contains from 85 to 99% by weight of the nickel-aluminum compound with the empirical formula $Al_2Ni_{21}O_{23}$ and the bottom section of the coating of the present invention, after the leaching and passivation steps, contains from 85 to 99% by weight of the nickel-aluminum compound with the empirical formula $Al_2Ni_4O_4$.

The scope of the present invention should not be limited to the specific examples and descriptions provided in the foregoing specification. An artisan of ordinary skill will readily appreciate the numerous minor modifications that may be made to the present invention without departing from its spirit and scope as outlined in the claims appended hereto.

What is claimed is:

1. A process for the production of a coated nickel body comprising the following steps:

a) covering a nickel body with a dispersion consisting essentially of aluminum powder in a dispersing medium to form a first coating on the nickel body;

b) drying the first coating to remove a portion of the dispersing medium to form an aluminum powder coating on the nickel body;

c) heating the nickel body bearing the aluminum powder coating in a furnace in a hydrogen or inert atmosphere so that any remaining portion of the dispersing medium is removed and the aluminum diffuses into the surface of the nickel body to form an intermediate coating; and d) leaching out at least a portion of the aluminum in the intermediate coating by contacting the intermediate coating with a leaching medium, wherein said dispersing medium consists essentially of a binder/solvent system.

2. A process according to claim 1, wherein the nickel body has holes that pass completely through the nickel body.

3. A process according to claim 1, wherein the solvent is water.

4. A process according to claim 1, wherein the solvent is an organic solvent.

5. A process according to claim 4, wherein the organic solvent is selected from the group consisting of normal propyl bromide, acetone, trichloroethylene and 1-1-1 trichloroethane.

6. A process for the production of a coated nickel body comprising the following steps:

a) covering a nickel body with a dispersion consisting essentially of aluminum powder in a dispersing medium to form a first coating on the nickel body;

b) drying the first coating to remove a portion of the dispersing medium to form an aluminum powder coating on the nickel body;

c) heating the nickel body bearing the aluminum powder coating in a furnace in a hydrogen or inert atmosphere so that any remaining portion of the dispersing medium is removed and the aluminum diffuses into the surface of the nickel body where it reacts with the nickel body to form an intermediate coating on the surface of the remaining portion of the nickel body that did not react with the aluminum;

d) leaching out at least a portion of the aluminum in the intermediate coating by contacting the intermediate coating with a leaching medium;

e) rinsing the intermediate coating, after the leaching step, with water; and f) passivating the intermediate coating to form a final coating on the surface of said remaining portion of the nickel body, said passivating comprising first contacting the intermediate coating with water at a temperature of about 180–212° F. and then contacting the intermediate coating with a solution of hydrogen peroxide in water, wherein said dispersing medium consists essentially of a binder/solvent system.

7. The process according to claim 6, wherein after step (f) the final coating consists essentially of an inner section that is in contact with the remaining portion of the nickel body and an outer section that is in contact with the inner section but not with said remaining portion of the nickel body, further wherein said outer section comprises at least 90% by weight $Al_2Ni_{21}O_{23}$ and said inner section comprises at least 90% by weight $Al_2Ni_4O_4$.

8. The process according to claim 1, wherein in step c), the nickel body bearing the aluminum powder coating is heated to a temperature of from 1400° F. to 1750° F.

9. The process according to claim 1, wherein in step c), the nickel body bearing the aluminum powder coating is heated to a temperature of from 1400–1500° F. for a time of from two minutes to thirty minutes.

10. The process according to claim 1, wherein in step c), the nickel body bearing the aluminum powder coating is heated to a temperature of from 1550–1750° F. for a time of from one minute to thirty minutes.

11. The process according to claim 1, wherein the leaching medium consists essentially of a solution of 20–25% by weight sodium or potassium hydroxide in water at a temperature of about 180–200F.

12. A process according to claim 1, wherein the solvent is an organic solvent and the binder is a polymeric material that is soluble in the organic solvent.

13. A process according to claim 12, wherein the organic solvent is selected from the group consisting of normal propyl bromide, acetone, trichloroethylene and 1-1-1 trichloroethane.

14. A process according to claim 6, wherein the solvent is water or an organic solvent.

15. A process according to claim 6, wherein the solvent is an organic solvent selected from the group consisting of normal propyl bromide, acetone, trichloroethylene and 1-1-1 trichloroethane.

16. A process according to claim 6, wherein the solvent is an organic solvent and the binder is a polymeric material that is soluble in the organic solvent.

17. A process for the production of a coated nickel body comprising the following steps:

a) covering a nickel body with a slurry consisting essentially of aluminum powder, a solvent and a binder to form a first coating on the nickel body;

b) drying the first coating to remove a portion of the solvent to form a second coating on the nickel body, said second coating consisting essentially of aluminum powder and said binder;

c) heating the nickel body bearing the second coating in a furnace in a hydrogen or inert atmosphere so that any remaining portion of the solvent and the binder are removed and the aluminum diffuses into the surface of the nickel body to form an intermediate coating; and d) leaching out at least a portion of the aluminum in the intermediate coating by contacting the intermediate coating with a leaching medium.

18. A process according to claim 17, wherein the solvent is selected from the group consisting of water and an organic solvent.

19. A process according to claim 17, wherein the solvent is an organic solvent selected from the group consisting of normal propyl bromide, acetone, trichloroethylene and 1-1-1 trichloroethane and the binder is an acrylate resin.

20. A process according to claim 17, wherein the slurry consists essentially of aluminum powder, water, propanol and polyvinyl alcohol.

* * * * *